United States Patent [19]

Villavicencio et al.

[11] Patent Number: 4,641,792

[45] Date of Patent: Feb. 10, 1987

[54] FIBER DEPITHER

[75] Inventors: Eduardo J. Villavicencio, San Angel, Mexico; Jorge E. Arana, Bethesda, Md.

[73] Assignee: Process Evaluation and Development Corporation, Dallas, Tex.

[21] Appl. No.: 663,590

[22] Filed: Oct. 22, 1984

[51] Int. Cl.[4] ..... B02C 13/28

[52] U.S. Cl. ..... 241/74; 241/89.2; 241/154; 241/162; 241/188 R; 241/191; 241/285 R; 19/26

[58] Field of Search ..... 241/51, 56, 74, 892, 241/86, 154, 160, 162, 185 A, 188 R, 189 R, 191, 257 R, 258, 285 R; 19/26, 65 A

[56] References Cited

U.S. PATENT DOCUMENTS

| | | | |
|---|---|---|---|
| 2,573,048 | 10/1951 | Newkirk et al. | 241/86 X |
| 3,537,142 | 11/1970 | Villaviciencio | 19/26 |
| 4,202,078 | 5/1980 | Malinak | 19/26 |

*Primary Examiner*—Howard N. Goldberg
*Assistant Examiner*—Timothy V. Eley
*Attorney, Agent, or Firm*—Michael J. McGreal

[57] ABSTRACT

The fiber depither consists of an upper array of feeder blades and a lower array of fan blades. These blades remove more particulate while resulting in less fiber damage.

7 Claims, 4 Drawing Figures

FIBER DEPITHER

This invention relates to an improved fiber depither. More particularly, this invention relates to a new hammer arrangement for a fiber depither.

A depither is a machine which removes the soft powdery component of a stalk from the fiber component. The depither will also remove dirt and small fragment material. In particular, depithers are used to process such materials as bagasse, bamboo, corn and other plant materials which have an inner soft pith containing section. The depither provides a separate, primarily fiber, product and a pith product. The pith is usually burned as a fuel while the fiber is used for paper making. In many countries, bagasse and bamboo are the only abundantly available fiber sources for papermaking.

Most depithers in use today are vertical depithers. These depithers consist of a rotor assembly which holds an array of blades and a perforated cylinder. This cylinder is also sometimes called the screen. The rotor assembly rotates within the cylinder with a clearance of about 1 to 2 cm between the cylinder and the ends of the blades of the rotor assembly. The rotor assembly is either directly driven by an electric motor or indirectly through a chain or gears. The rotor assembly will rotate at about 1500 to 3000 revolutions per minute (rpm) in use and consequently must be well balanced. The fibers being processed enter at the top of the cylinder and are processed by the blades on the rotor assembly as they move downward. The pith and other particulate are forced out of the area of the rotor assembly through the perforations in the cylinder. The fiber and the removed pith are then separately collected.

Depithers of one form or another have been used for decades in processing of bagasse and bamboo. A vertical depither which is in widespread use is the Peadco Depither. This depither is the subject of two U.S. Patents. These are U.S. Pat. No. 3,537,142 and U.S. Pat. No. 3,688,345. Another vertical depither known as the Gunkel depither is shown in U.S. Pat. No. 3,622,088. This depither is designed for installations with space constraints. A basic vertical depither design is set forth in U.S. Pat. No. 2,082,419 and U.S. Pat. No. 2,153,590. These are generally known as Reitz depithers. Horizontal depithers have been used in the past but are not used today. U.S. Pat. No. 3,011,220 and U.S. Pat. No. 2,729,856 illustrate two different types of horizontal depithers.

The objective in a depither design is to remove a maximum amount of pith while causing a minimum amount of fiber damage. The fiber bundles should be broken and the pith and other particulate removed. However, the working on the fiber has to be of a type which will not fracture or otherwise weaken the fiber. The reason is that fibers from bamboo, bagasse and related vegetable fiber sources are relatively short when compared to fiber from wood. Since paper strength is related to fiber length, any breaking of the fibers during depithing will weaken the end product paper. However, a competing consideration is that as the amount of pith left in the fiber increases, the strength of the end product paper decreases. Consequently, processing equipment and techniques have to be developed to remove as much pith as possible while minimizing fiber damage. This present invention is directed to this end.

In brief summary, this invention is directed to an improved vertical depither having two depithing sections. The upper depithing section has uppermost fiber feeding blades and a series of conventional depithing blades. The lower depither section has a series of conventional depithing blades with the lowermost blades being fan blades. The uppermost fiber feeding blades serve to break the large fiber bundles and to orient the fibers against the screen in a vertical orientation. The various depithing blades will then move the fibers down along the inside surface of the screen. The lower fan blades serve to push pith and other particulate material through the screen. This provides a final fiber cleaning.

The present invention will be disclosed in more detail with reference to the following drawings.

Figure 1:
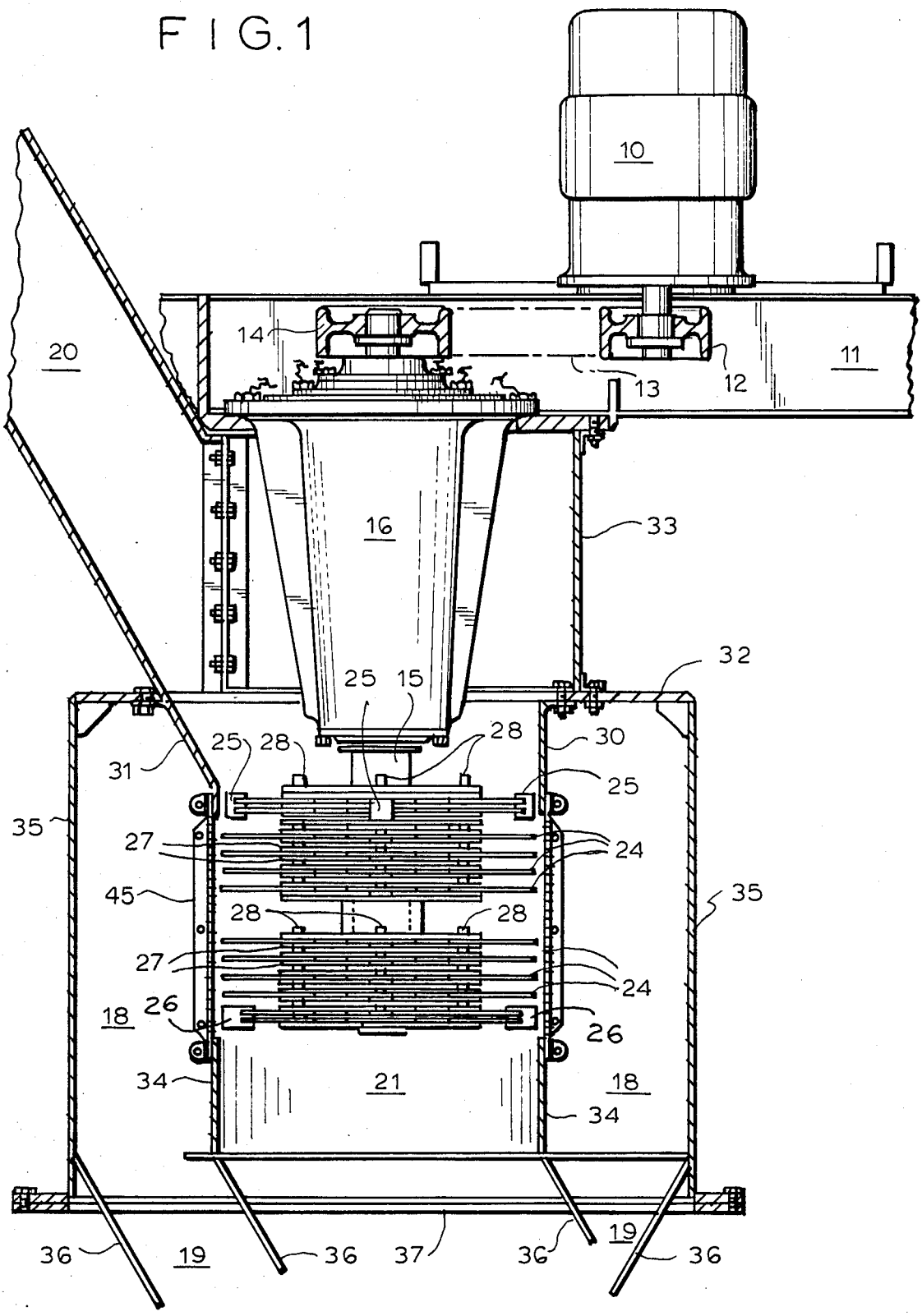
FIG. 1 is an elevational view in section of the improved depither rotor and chamber section.

The present depither will be discussed in the context as an improvement to the depither of U.S. Pat. No. 3,537,142. This patent is incorporated herein by reference. However, the noted improvements can be used with any vertical depither. In FIG. 1, beam 11 supports drive motor 10 which drives pulley 12. Belt 13 transmits the drive energy from pulley 12 to pulley 14 at the top of the rotor assembly. Housing 16 holds the lower rotor assembly in a defined orientation and also protects the bearings and other drive shaft parts from the input fiber material. The rotor assembly consists of rotor shaft 15 and blades 24, 25 and 26. The blades are held in place by plates 27 and securing shafts 28. That is each blade is secured between two plates. Each blade has a hole to accept a securing shaft. This rotor is suspended in area 21 which is the interior of perforated cylindrical chamber 45. This perforated chamber is also known as a basket or a screen. The blades of the rotor assembly have a clearance of about 1 to 2 cm. between the ends of the blades and the cylindrical chamber. This perforated chamber is descrjbed in more detail in FIG. 2.

The fiber delivery section consists of entrance chute 20 which feeds the fiber into area 21. The rotation of the rotor assembly causes the entering fibers to be thrown outwardly. At this point, feeder blades 25 contact the fibers and serve to break-up the larger fiber aggregates. Also, in the area of contact by feeder blades 25 there are no perforations in the cylindrical chamber. This results in more working of the fiber. As can be seen in FIG. 1, the chamber at the area of the feeder blades is the connecting area where the cylinder is mounted to the depither body. This is by means of item 30 and extension 31 of the input chute which are in turn bolted to upper housing member 32. Brace member 33 attaches the depither body to support the beam 11. Screws and bolts are conveniently used as the means for joining various sections.

The lower part of the perforated chamber is connected to housing 34 which directs the fiber component downward for collection. Around the exterior of the perforated chamber is housing 35 which defines an area 18 between the perforated chamber and the housing. This is the area where pith and other particulate matter collects and flows downward through opening 19 to be collected. Sheet metal chutes 36 direct the flow of pith. Ring 37 defines the bottom of the depither.

Figure 2:
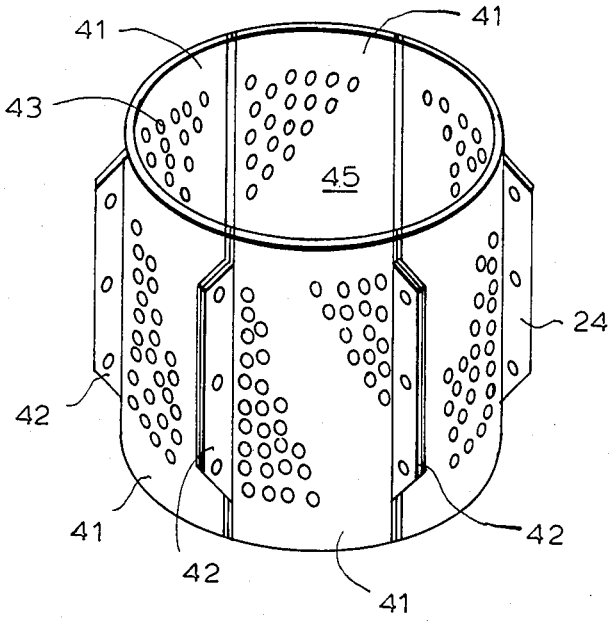
FIG. 2 is a perspective view of the depither chamber.

FIG. 2 is a view of the perforated cylinder 40. This chamber is comprised of six sections 41 which are bolted together at flanges 42. A multi-section chamber provides easier access to the rotor assembly and thus easier maintenance on this critical part of the depither. The perforated chamber has holes of a diameter of about 0.25 cm. to 0.75 cm. The perforated chamber has about a 30 to 50 percent open area. The entire cylinder contains perforations except on about the upper 6 cm. This is the area where the perforated cylinder is attached to other sections of the depither. The perforated cylinder has a thickness of about the diameter of the cylinder perforations.

Figure 3:
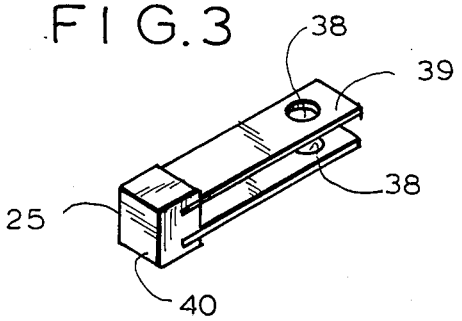
FIG. 3 is a perspective view of a feeder blade.

FIG. 3 shows a feeder blade. This feeder blade consists of two legs 39 and head portion 40. Each leg has a hole 38 to accept a connecting shaft. The head of the feeder blade is shown as square. However, this need not be the case. Triangular, rectangular, pentagonal and similar shapes are useful.

Figure 4:
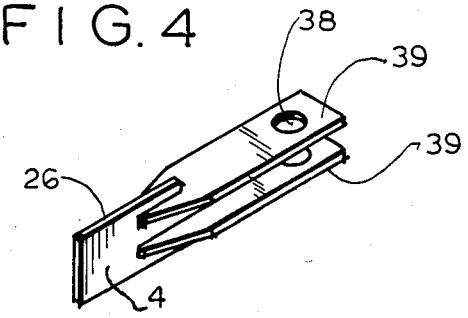
FIG. 4 is a perspective view of a fan blade.

FIG. 4 shows a fan blade. This consists of the fan portion 41 connected to legs 39. As with the feeder blade, each leg has a hole to accept a connecting shaft. These legs are sandwiched between the plates in the rotor assembly.

In operation, the rotor assembly is operated at about 1500 rpm. The fiber material to be depithed is flowed into chute 20 and falls by gravity into the rotor assembly area. The first blades to strike the fiber material are the feeder blades. The feeder blades break-up the large fiber aggregates and also orient the fibers against the inner surface of the cylindrical chamber. There are no perforations at this section of the chamber since the fibers getting oriented would tend to go into the holes and be broken rather than to orient vertically on the inner surface of the chamber. The fibers are then contacted with the lower conventional blades which can have flat or partially rounded ends. At this point the pith and other particulate removed from the fibers goes through the perforations in the screen to the area 18 for collection. The fibers keep moving downward leaving the upper blade section and being reoriented in the lower blade section. At the lower end of the lower blade section, the fan blade pushes air against the fibers and removes much of the clinging pith. The fibers then fall downwardly and are collected.

A depither is operated continuously. A typical depither having a 38 inch diameter screen (perforated cylinder) can process about 150 bone dry metric tons of fiber per day. The fiber leaving the depither will be substantially deaggregated and will have a pith content of less than about five percent. This depithing can be either a moist or wet depithing. In moist depithing, the fiber material has a water content of about 50 to 55 weight percent and in wet depithing a water content of above 80 weight percent. The present improvements can be used in any size depither and in both wet and moist depithers. In any of these embodiments, they provide for greater pith removal and less fiber damage.

What is claimed is:

1. An improved depithing device comprising an inlet to permit the flow of fiber into a circular chamber having a perforated wall structure, an outlet from said circular chamber, a rotor carrying an upper plurality of blades and a lower plurality of blades centered for rotation within said circular chamnber, means to rotate said rotor, and a chamber surrounding said circular chamber and adapted to receive material passing through the perforated wall of said circular chamber; the improvement comprising said rotor having a separated upper and a lower plurality of blades; the uppermost blades of said upper plurality of blades being feeder blades having an end surface area at least 2 times the end surface area of the remaining blades; and the lowermost blades of said lower plurality of blades being fan blades wherein the outer end of said blades have a ratio of height to width of at least 5.

2. An improved depithing device as in claim 1 wherein the surface of said circular chamber adjacent said feeder blades is continuous.

3. An improved depithing device as in claim 2 wherein said feeder blades comprise up to $\frac{1}{3}$ of the total number of blades of said upper plurality of blades.

4. An improved depither device as in claim 3 wherein said fan blades comprise up to $\frac{1}{3}$ of the total number of blades of said lower plurality of blades.

5. An improved depither device as in claim 1 wherein said circular chamber is comprised of a plurality of individual sections.

6. An improved depither device as in claim 5 wherein said circular chamber is comprised of at least four sections.

7. An improved depithing device as in claim 1 wherein there is a space between said upper plurality of blades and said lower plurality of blades of at least 12 cm.

* * * * *